US009757749B2

(12) United States Patent
Bloc

(10) Patent No.: US 9,757,749 B2
(45) Date of Patent: Sep. 12, 2017

(54) SYSTEM FOR DISTRIBUTING A FLUID PRODUCT WHICH IS PACKAGED IN A TANK

(71) Applicant: ALBEA LE TREPORT, Le Treport (FR)

(72) Inventor: Richard Bloc, Derchigny-Graincourt (FR)

(73) Assignee: ALBEA LE TREPORT, Le Treport (FR)

( * ) Notice: Subject to any disclaimer, the term of this patent is extended or adjusted under 35 U.S.C. 154(b) by 0 days.

(21) Appl. No.: 14/666,392

(22) Filed: Mar. 24, 2015

(65) Prior Publication Data

US 2015/0273504 A1 Oct. 1, 2015

(30) Foreign Application Priority Data

Mar. 25, 2014 (FR) ..... 14 52540

(51) Int. Cl.
*B05B 11/00* (2006.01)
*B65D 47/20* (2006.01)
(Continued)

(52) U.S. Cl.
CPC ..... *B05B 11/0005* (2013.01); *B65D 47/2081* (2013.01); *B05B 11/0072* (2013.01);
(Continued)

(58) Field of Classification Search
CPC .. B65D 47/205; B65D 47/2081; B65D 35/28; B65D 35/38; B65D 35/46; B65D 37/00;
(Continued)

(56) References Cited

U.S. PATENT DOCUMENTS 4,061,254 A * 12/1977 Nilson ..... B05B 11/0072 137/508
4,394,939 A * 7/1983 Thor ..... A47K 5/1201 137/854
4,699,300 A * 10/1987 Blake ..... B65D 47/2081 222/212
5,197,636 A * 3/1993 Mitchell ..... A61L 12/102 134/901
5,431,310 A * 7/1995 Kanner ..... B05B 11/0021 222/212
5,692,651 A * 12/1997 Fuchs ..... B65D 47/2081 222/494
6,974,053 B2 * 12/2005 Lautre ..... B65D 47/2081 222/212
(Continued)

FOREIGN PATENT DOCUMENTS

EP 1147994 A1 10/2001
FR 2989290 A1 10/2013
(Continued)

OTHER PUBLICATIONS

Oct. 17, 2014—FR Search Report—App 1452540.

*Primary Examiner* — Paul R Durand
*Assistant Examiner* — Andrew P Bainbridge
(74) *Attorney, Agent, or Firm* — Banner & Witcoff, Ltd.

(57) ABSTRACT

A system for distributing a fluid product which is packaged in a tank, the system comprises a base and a cap which are intended to be mounted on the tank together forming a distribution chamber which has a supply passage for packaged product, the cap having a wall which is provided with a skirt for assembly on the tank and a sleeve which is arranged around a nozzle of the base forming between the sleeve and the nozzle a distribution interface which opens in a distribution hole formed in the wall, the wall being reversibly deformable by the pressure of the product in the distribution chamber from a stable closed state of the interface in which the sleeve is arranged in sealed contact around the nozzle towards a deformed opening state of the interface in which the sealed contact is broken in order to allow the distribution of the product contained in the distribution chamber through the distribution hole.

11 Claims, 3 Drawing Sheets

(51) Int. Cl.
*B65D 83/00* (2006.01)
*B65D 47/06* (2006.01)

(52) U.S. Cl.
CPC ..... *B65D 47/061* (2013.01); *B65D 47/066* (2013.01); *B65D 47/205* (2013.01); *B65D 47/2018* (2013.01); *B65D 47/2056* (2013.01); *B65D 47/2062* (2013.01); *B65D 47/2087* (2013.01); *B65D 47/2093* (2013.01); *B65D 83/00* (2013.01)

(58) Field of Classification Search
CPC ..... B65D 83/00; B65D 47/04; B65D 47/10; B65D 47/2018; B65D 47/2056; B65D 47/2062; B65D 47/2061; B65D 47/2087; B65D 47/2093; B65D 47/241; B65D 47/243; B65D 47/066; B65D 47/061; F16K 17/02; F16K 17/04; B05B 11/00; B05B 11/005; B05B 11/007; B05B 11/04; B05B 11/0064; B05B 11/0067; B05B 11/0072
USPC ..... 222/215, 491–497, 519–525, 212–213, 222/559
See application file for complete search history.

(56) References Cited

U.S. PATENT DOCUMENTS

| | | | | |
|---|---|---|---|---|
| 7,516,874 | B2 * | 4/2009 | Kneer | B65D 47/205 222/497 |
| 8,517,222 | B2 * | 8/2013 | Painchaud | B65D 47/18 222/212 |
| 8,534,509 | B2 * | 9/2013 | Duquet | B65D 47/2068 222/212 |
| 8,863,998 | B2 * | 10/2014 | Painchaud | B05B 11/0021 222/1 |
| 2003/0094467 | A1 * | 5/2003 | Dark | B65D 47/2081 222/484 |
| 2007/0257063 | A1 * | 11/2007 | Schliemann | B05B 11/0067 222/207 |
| 2009/0321479 | A1 * | 12/2009 | Fontana | B65D 47/2068 222/494 |

FOREIGN PATENT DOCUMENTS

| | | | |
|---|---|---|---|
| JP | HO7223662 | | 8/1995 |
| WO | 9964313 | A1 | 12/1999 |

* cited by examiner

SYSTEM FOR DISTRIBUTING A FLUID PRODUCT WHICH IS PACKAGED IN A TANK

CROSS REFERENCE TO RELATED APPLICATIONS

This application claims priority to French Application Serial No. 1452540, filed Mar. 25, 2014, which is hereby incorporated by reference in its entire.

FIELD

The invention relates to a system for distributing a fluid product which is packaged in a tank, and a receptacle which comprises such a system which is mounted on a deformable tank in which a fluid product is intended to be packaged in order to allow the product to be distributed by means of manual pressure on the tank.

In a specific application, the fluid product is of the lotion, gel or cream type, for example, for use in cosmetics or for pharmaceutical treatments.

BACKGROUND

Systems are known in which the distribution of the product is carried out at the interface between a membrane and a nozzle. To this end, the membrane is reversibly deformable via the pressure of the product thereon from a stable closed state, in which the membrane is in sealed contact around the nozzle, to a deformed opening state in which the sealed contact is broken in order to allow the product to be distributed via a distribution hole.

This construction enables, between two distribution actions, a closure of the distribution hole in order to prevent in particular deterioration of the product stored in the vicinity of the hole via contact with the outside air. In particular, the deterioration may involve drying and/or oxidation of the product but also contamination thereof by bacteria and/or fungi.

However, since the closure is produced at the interface between two geometries which are often imperfect, there is the problem of the sealing thereof with respect to the air and/or contaminants. In order to attempt to make this sealing more reliable, document FR 2 989 290 proposes the use of a resilient member which is interposed between a cap and the membrane in order to be able to assist and constrain the return of the membrane into the sealed closed state.

If this solution is satisfactory in terms of the sealing provided, it remains relatively restrictive to implement, in particular in relation to the number of components required and their assembly in terms of interaction.

SUMMARY

The invention is intended to improve the prior art by providing in particular a distribution system whose sealing with respect to the air and/or contaminants is made more reliable with respect to a simplification of the construction of the system.

To this end, according to a first aspect, the invention provides a system for distributing a fluid product which is packaged in a tank, the system comprising a base and a cap which are intended to be mounted on the tank together forming a distribution chamber which has a supply passage for packaged product, the cap having a wall which is provided with a skirt for assembly on the tank and a sleeve which is arranged around a nozzle of the base forming between the sleeve and the nozzle a distribution interface which opens in a distribution hole formed in the wall, the wall being reversibly deformable by the pressure of the product in the distribution chamber from a stable closed state of the interface in which the sleeve is arranged in sealed contact around the nozzle towards a deformed opening state of the interface in which the sealed contact is broken in order to allow the distribution of the product contained in the distribution chamber through the distribution hole.

According to a second aspect, the invention provides a receptacle which comprises a deformable tank in which a fluid product is intended to be packaged, the receptacle comprising such a distribution system which is mounted on the tank in order to allow the product to be distributed by means of manual pressure on the tank.

BRIEF DESCRIPTION OF THE DRAWINGS

Other objectives and advantages of the invention will be appreciated from the following description, given with reference to the appended figures, in which.

DETAILED DESCRIPTION

Figure 1A:
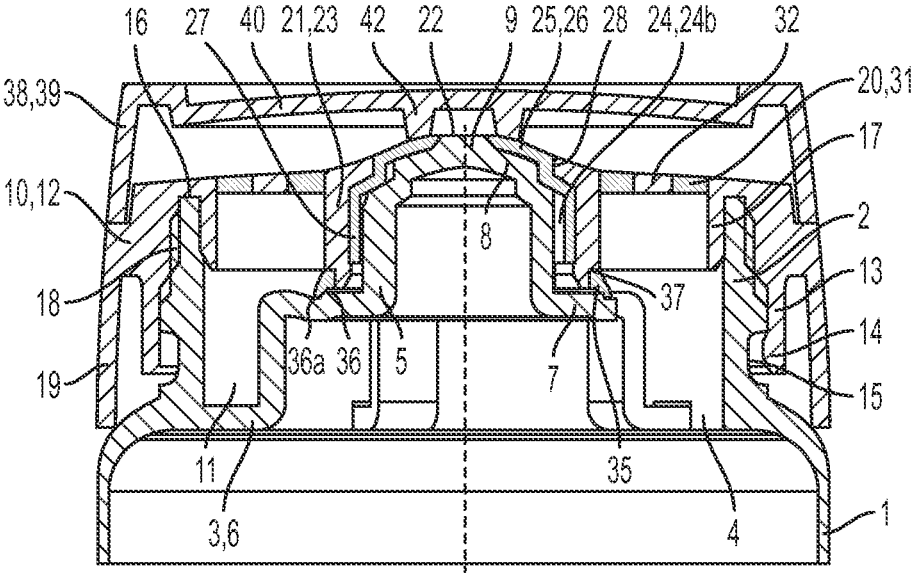
FIGS. 1*a* and 1*b* are partial longitudinal sections of a receptacle according to an embodiment of the invention, in which the cap of the distribution system is in a closed state of the distribution interface, with the cover mounted (FIG. 1*a*) and without the cover (FIG. 1*b*), respectively.

In relation to the figures, a receptacle is described which comprises a deformable tank 1 in which a fluid product can be packaged. In one application example, the product is a lotion, a gel or a cream, for cosmetic use or for pharmaceutical treatments.

The receptacle comprises a distribution system which is mounted on the tank 1 in order to allow the distribution of the product by means of manual pressure on the tank. In the description, the terms of positioning in space are taken with reference to the straight position of the distribution system and the tank as illustrated in the figures.

The tank 1 is advantageously formed inside a flexible body, in particular produced from polyolefin, for example, in the form of a flexible tube. The body is surmounted by a neck 2 which defines an upper opening for the tank 1 and in which the distribution system is arranged whilst being supplied with product by means of reversible manual deformation of the tank 1.

The distribution system comprises a base 3 which is connected to the neck 2 of the tank 1 in order to allow the passage of the pressurised product between the neck and the base. The base 3 may be associated with the neck 2 by assembly means, for example, snap-fitting means. Advantageously, the base 3 is integrated in one piece in the neck 2, for example, by moulding a thermoplastic material, forming between the neck and the base at least one passage 4 for supplying product.

The base 3 is provided with a fixed nozzle 5 which extends axially inside the neck 2, in particular at the centre thereof. According to the embodiment illustrated, the nozzle 5 is connected to the neck 2 via connection lugs 6 which are distributed angularly forming between two adjacent lugs 6 passages 4 from the tank 1 to the nozzle. The nozzle 5 has a peripheral surface which extends axially from a base 7 to which the lugs 6 are connected towards a distal end 8 on which a nipple 9 extends axially.

The distribution system further comprises a cap 10 which is mounted on the tank 1 so as to cover the base 3 in order to form between them a product distribution chamber 11. In particular, the distribution chamber 11 is in communication with the tank 1 via at least one passage 4 so that the pressurisation of the product in the tank allows the chamber to be supplied with product.

The cap 10 has a skirt 12 which is arranged for the assembly thereof on the tank 1 forming the distribution chamber 11 with the base 3. To this end, the neck 2 has association means on which the skirt 12 is mounted in a sealed manner.

In relation to the figures, the assembly skirt 12 has an outer axial crown 13 which is provided with internal rings 14 for snap-fitting in an outer recess 15 of the neck 2. In particular, the skirt 12 has an annular housing 16 formed between the axial crown 13 and an inner axial extent 17 of the skirt, the mouth of the neck 2 being clamped in a sealed manner in the housing when the skirt 12 is snap-fitted on the neck.

Furthermore, the periphery of the neck 2 has axial ridges 18 which are engaged in the housing 16 of the skirt 2 in order to prevent the rotation of the cap 10 relative to the neck. For aesthetic reasons, the skirt 12 is also provided with an outer trim 19 for concealing the crown 13 and the neck 2.

The cap 10 has a wall 20 whose outer periphery is provided with the skirt 12, the axial crown 13 extending below the wall. The wall 20 is further provided with a sleeve 21 which is surmounted by a distribution hole 22 formed in the wall. In particular, the removal surface of the product is formed on the wall which can be arranged so as to facilitate the removal, in particular by moving a finger over the surface in the region of the distribution hole 22.

The sleeve 21 comprises a conduit 23 which extends in an annular manner below a central portion of the wall 20 in a concentric manner with respect to the outer crown 13. Advantageously, the cap 10 is formed in one piece, integrating the wall 20, the assembly skirt 12 and the conduit 23, in particular by means of moulding a thermoplastic material.

The sleeve 21 is arranged around the nozzle 5, together forming a product distribution interface 24 which is supplied by the distribution chamber 11, the interface opening in the distribution hole 22 for the discharge of the product. In the embodiment illustrated, the sleeve 21 comprises an end-piece 25 which is mounted in a fixed manner in the conduit 23, the distribution interface 24 being formed between the end-piece and the peripheral surface of the nozzle 5.

The end-piece 25 is produced in one piece from a rigid material which is identical to or different from that of the conduit 23, in particular based on a metal and/or thermoplastic material, for example, of acrylonitrile butadiene styrene (ABS) or polypropylene. The end-piece 25 has a cover 26 in which the distribution hole 22 is formed and below which a peripheral ring 27 of the end-piece extends axially.

The end-piece 25 may be mounted in the conduit 23, for example, by means of overmoulding, having an inner geometry which complements the outer geometry of the nozzle 5. In particular, the conduit 23 has an upper opening 28 in which the cover 26 is arranged, the inner and outer surfaces of the cover forming an inner extent 29 and an outer extent 30 of the wall 20, respectively. The outer extent 30 has a convex geometry extending in the continuation of the upper surface of the conduit 23 and delimiting the opening 28.

The cover 26 is arranged so that the distribution hole 22 is arranged opposite the nipple 9 of the nozzle 5, the interface between the inner extent 29 and the distal end 8 of the nozzle forming a downstream portion 24*a* of the distribution interface 24 which opens in the distribution hole 22. The ring 27 extends in the conduit 23 forming an upstream portion 24*b* of the distribution interface 24 with the peripheral surface of the nozzle 5.

In order to allow the distribution of the product, the wall 20 can be reversibly deformed by the pressure of the product in the distribution chamber 11 from a stable closed state of the distribution interface 24 (FIG. 1) in which the sleeve 21 is arranged in sealed contact around the nozzle 5 to a deformed opening state of the interface (FIG. 2) in which the sealed contact is broken in order to allow the distribution of the product contained in the distribution chamber 11 through the interface 24 then the distribution hole 22.

In particular, the deformation of the wall 20 from a stable state to a deformed state brings about the axial displacement of the sleeve 21 relative to the nozzle 5, the end-piece 25 being arranged from a low position, in which the hole 22 and the inner extent 29 are arranged in a sealed manner around the nipple 9 and on the distal end 8, respectively, to a high position in which the hole and the inner extent are moved away from the nipple and the distal end, respectively.

In the absence of pressure of the product, the wall 20 is arranged so as to allow a sealed pressing force of the inner extent 29 on the distal end 8 of the nozzle 5, with the distribution hole 22 engaged in a sealed manner around the nipple 9, in order to close both the hole and the distribution interface 24.

Advantageously, the nipple 9 has a frustoconical geometry which diverges from top to bottom, the distribution hole 22 having a complementary geometry so that the pressing of the cover 26 on the distal end 8 reinforces by means of radial clamping the sealing conferred between two distribution actions.

Figure 2:
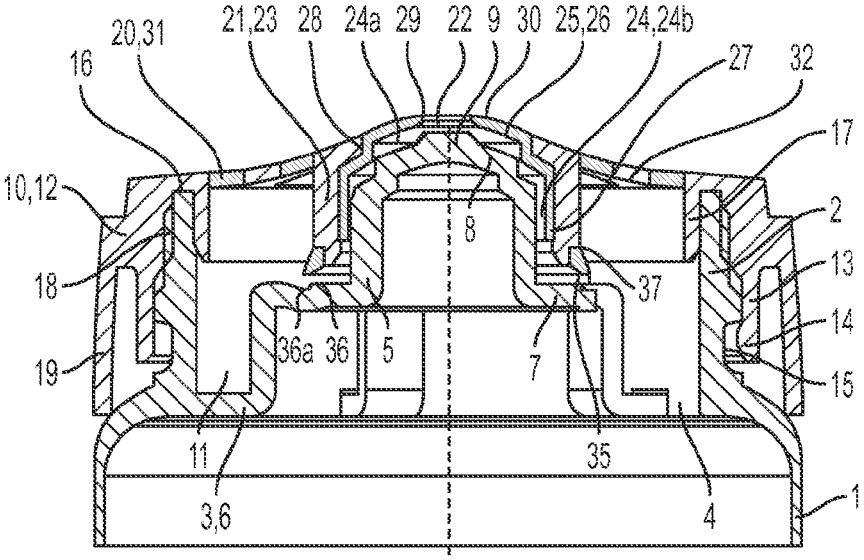
FIG. 2 is a partial longitudinal section of the receptacle according to FIG. 1, in which the distribution system is in an open state of the distribution interface.

In relation to FIG. 2, under the pressure of the product, the wall 20 is deformed towards the outer side, simultaneously moving away the cover 26 for the opening of the hole 22 and the downstream portion 24*a* of the distribution interface 24, respectively. In this manner, by means of manual pressure on the tank 1, the product moves successively via at least one supply passage 4, the chamber 11, then the distribution interface 24 in order to be recovered via the distribution hole 22.

The wall 20 comprises a deformable membrane 31 which connects the assembly skirt 12 and the sleeve 21, the membrane extending in particular between the axial inner extent 17 and the conduit 23. The membrane 31 can be reversibly deformed by means of pressure of the product on it in order to arrange the wall 20 in the deformed opening state, in particular by actuating the raising of the end-piece 25 relative to the nozzle 5.

The wall 20 further comprises arms 32 which are arranged in the membrane 31 and which connect the skirt 12 for assembly to the conduit 23. In particular, the arms 32 are arranged in order to, when the membrane 31 is in the stable state, apply a pressing force of the cover 26 to the distal end 8 and, when the membrane is in the deformed state, resiliently deform in order to be able to assist the return of the membrane into the stable state.

In relation to the figures, the arms 32 are produced in one piece when the cap 10 is moulded, forming the skirt 12 and the conduit 23. The material and the geometry of the connection arms 32 are arranged so as to promote the return of the wall 20 into the stable state at the end of distribution, by applying a force for pressing the sleeve 21 around the nozzle 5 which is sufficient to prevent deterioration, in particular drying and/or oxidation, but also contamination by bacteria and/or fungi, of the product stored in the distribution interface 24 by contact with the outer side.

The membrane 31 is produced from material which is sealed with respect to the product and is arranged, in particular by means of overmoulding, between the arms 32. In this manner, the wall 20 forms a barrier with respect to the product contained in the distribution chamber 11, the pressurisation of the product bringing about an inflation of the membrane 31 in order to actuate the raising of the sleeve 21. Advantageously, the membrane 31 is produced from material having an elastomer property, the membrane being able to be produced, in particular by means of moulding, based on an elastomer polymer, such as poly(oxymethylene) or polypropylene of the Adflex type, from a silicone or a thermoplastic elastomer (TPE).

The embodiment illustrated makes provision for the peripheral surface of the nozzle 5 to be provided with axial flutes 33 which are arranged in the distribution interface 24 and which allow at least one distribution passage between them, the flutes ensuring the guiding of the movement of the end-piece 25 around the nozzle whilst retaining a controlled geometry for the upstream portion 24*b* of the interface. Furthermore, the distal end 8 of the nozzle 5 is bordered by communication notches 34 between the downstream portion 24*a* and upstream portion 24*b* of the distribution interface 24.

In order to prevent deterioration of the product to be distributed, the sleeve 21 may be provided with an annular sealing joint 35 which is interposed between the sleeve and an extent 36 of the base 3. The joint 35 is arranged so as to close the communication between the interface 24 and the distribution chamber 11 when the wall 20 is in the stable closed state, the deformation of the wall opening the communication in order to allow the distribution interface to be supplied with product.

According to the embodiment illustrated, the annular joint 35 is arranged in an outer annular recess 37 which is formed around the lower end of the conduit 23, for example, in a state associated therewith, in particular by means of overmoulding. The extent 36 of the base 3 extends radially on the base 7 of the nozzle 5 and has a groove 36*a* in which the joint 35 is arranged in tight abutment.

The joint 35 may be produced from material which is different from that of the conduit 23, in particular more flexible, for example, being similar to the one which forms the membrane 31 and which is associated during the same overmoulding. In particular, the closure force of the wall 20 brings about a compression of the joint 35 between the conduit 23 and the extent 36 of the base 3, which contributes to sealing, between two uses, the closure of the communication between the upstream portion 24*b* of the interface 24 and the distribution chamber 11.

Advantageously, at least a portion of the wall 20 may be capable of providing a microbiocidal or at least microbiostatic action in the product which, between two distribution actions, is located on the wall, in order to prevent introduction of bacteria and fungi in the receptacle via the distribution interface 24.

In particular at least the outer extent 30 of the wall 20 is arranged in order to ensure the decontamination of the product in the immediate vicinity of the distribution hole 22, in the region in which the risk of contaminants being introduced is greatest. Advantageously, the end-piece 25 is produced from a material which is capable of providing a microbiocidal or at least microbiostatic action in the product, in particular in the product contained in the distribution interface 24. In this manner, even in the case of slight re-suction of product in the distribution interface 24, it is decontaminated when it is immobilised between two uses in order to risk neither the subsequent distribution of a dose of contaminated product, nor the retro-contamination of the product packaged in the tank 1.

In a complementary manner, the membrane 31, the connection arms 32 and/or the nozzle 5 may ensure a microbiocidal or at least microbiostatic action so that in particular the whole of the surface for removing the product can decontaminate the occurrences of contamination formed by spreading the product on the surface when it is recovered by the finger of the user.

In order to confer the microbiocidal or at least microbiostatic function, it is possible to make provision for the use of at least one material which has microbiocidal properties by means of diffusion of an antimicrobial agent, by means of contact with a microbiostatic agent and/or by means of irradiation with radiation having a suitable wavelength.

In particular, the antimicrobial agent may be organically based, such as Triclosan (commercial name from the company Melcoplast) or silver-based or even mineral. In particular, the material may comprise at least one polyolefin, for example, polyethylene, polypropylene and/or polystyrene which is charged with at least one antimicrobial agent.

The microbiostatic agent may be a metal material, such as an alloy of copper or zinc, or a material comprising at least one polyolefin which is charged with metal particles or which has been subjected to a surface treatment by means of fluorination, zinc-coating or copper-coating.

For decontamination by means of irradiation, it is possible to use a material which has photoluminescence properties after exposure to external light. In particular, the material may be based on a material which comprises at least one polyolefin charged with at least one additive which is capable of emitting photoluminescent radiation which has a wavelength of between 250 and 260 nanometers, and in particular 254 nanometers, which corresponds to the order of magnitude of sterilising ultraviolet radiation.

In the embodiment illustrated, the distribution system comprises a cover 38 which is intended to cover the cap 10 between two distribution actions, the cover having a skirt 39 which is associated in a reversible manner with the cap and a solid upper wall 40 which is arranged above the wall 20.

The skirt 39 is associated with the cap 10 by means of a hinge 41 which allows the cover 38 to be arranged in a remote distribution position (FIG. 3) and in an assembled storage position between two uses (FIG. 1*a*) in which the upper wall 40 is arranged above the cap in order to at least partially close the distribution hole 22.

The cover 38 comprises at least one protrusion 42 which is arranged so as to move into abutment with the wall 20 when the cover is associated on the cap 10. In this manner, if the tank 1 is pressed between two uses, the protrusion 42 prevents the sleeve 21 from being raised and therefore prevents product from being discharged via the distribution hole 22.

Figure 1B:
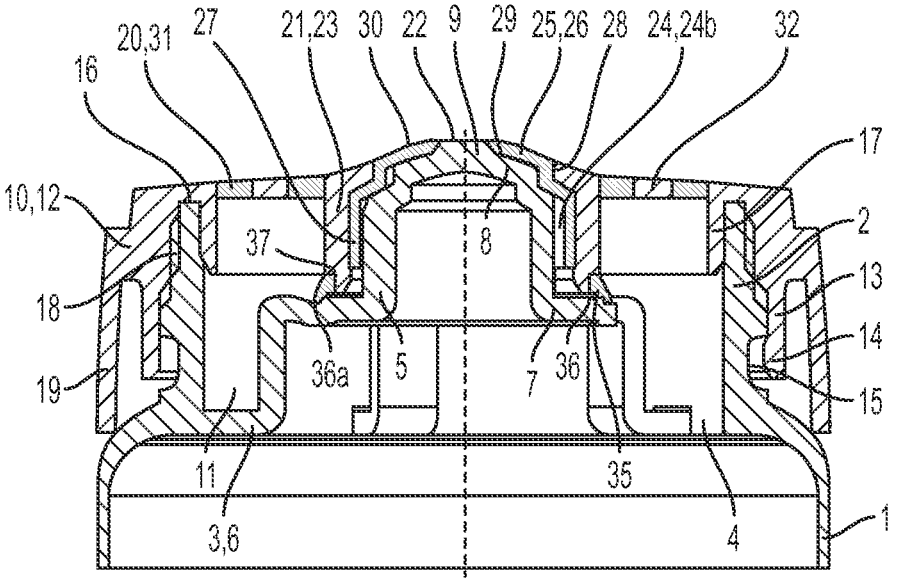
Figure 3:
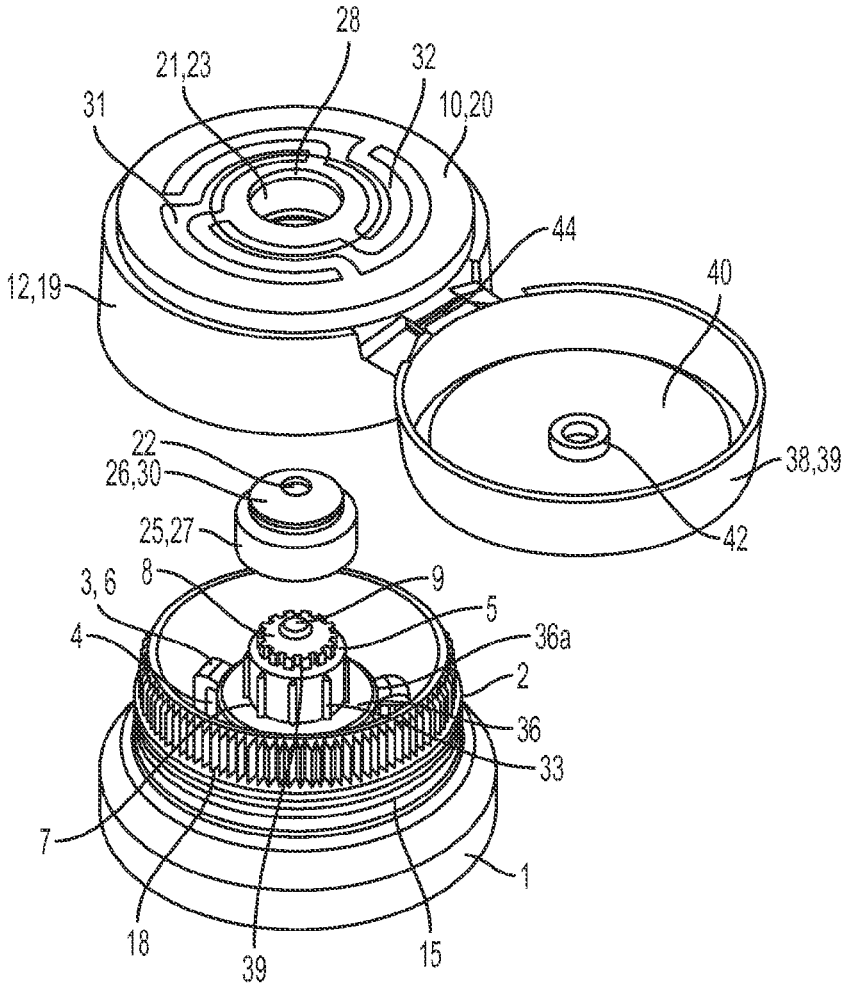
FIGS. 3 and 4 are partial views of the receptacle according to FIG. 1, showing an exploded view of the distribution system in perspective (FIG. 3) and in longitudinal section (FIG. 4), respectively.
Figure 4:
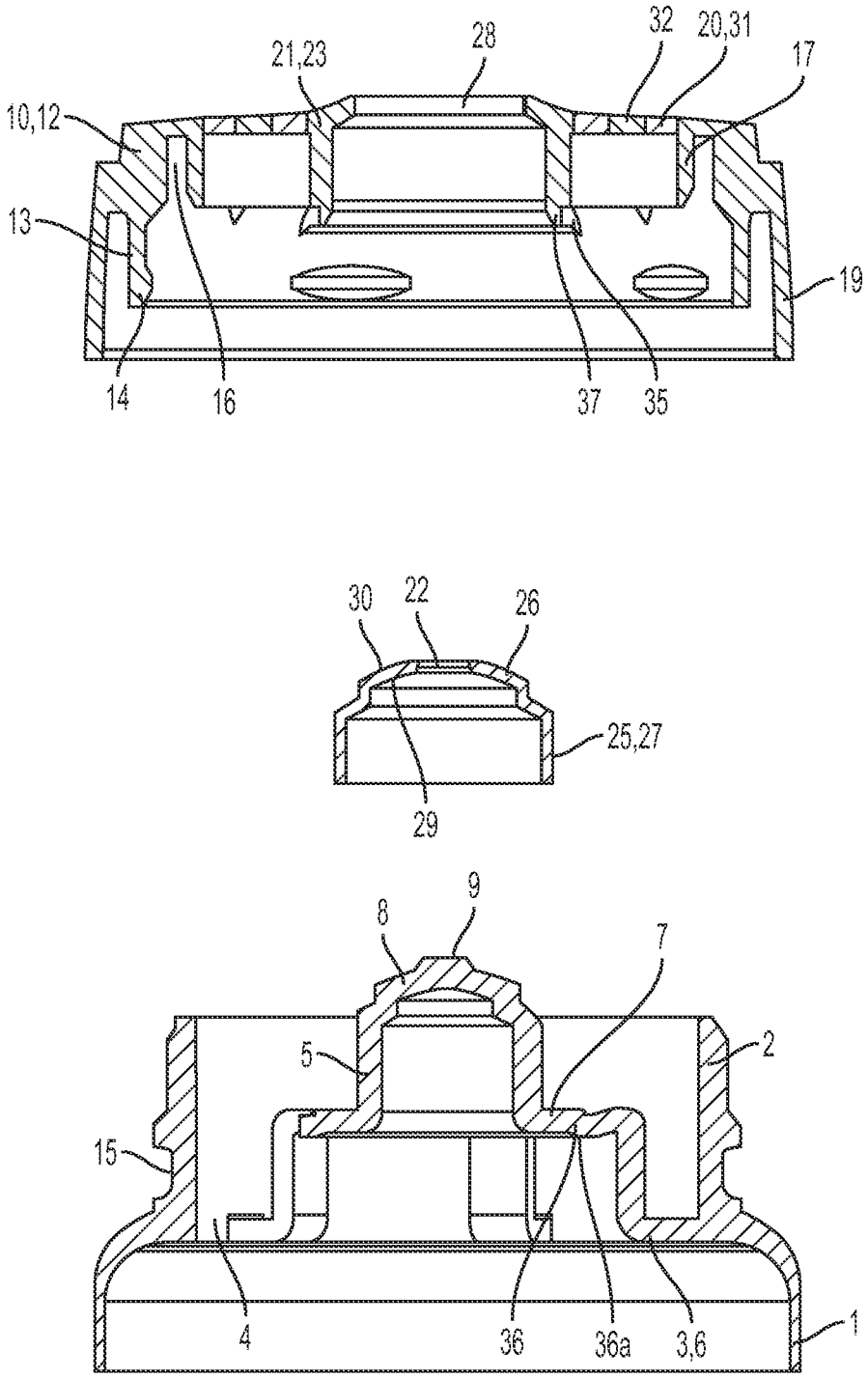

In relation to FIGS. 1*a* and 3, the upper wall 40 is provided with an annular lower protrusion 42 whose geometry is arranged in order to apply pressure to the outer extent 30 around the distribution hole 22.

I claim:

1. System for distributing a fluid product which is packaged in a tank, the system comprising a base and a cap which are intended to be mounted on the tank together forming a distribution chamber which has at least one supply passage for packaged product, the cap having a wall which is provided with a skirt for assembly on the tank and a sleeve which is arranged around a nozzle of the base forming between the sleeve and the nozzle a distribution interface which opens in a distribution hole formed in the wall, the system being characterised in that the wall is reversibly deformable by the pressure of the product in the distribution chamber from a stable closed state of the interface in which the sleeve is arranged in sealed contact around the nozzle towards a deformed opening state of the interface in which the sealed contact is broken in order to allow the distribution of the product contained in the distribution chamber through the distribution hole;

wherein the skirt is connected to the sleeve via a deformable membrane and arms for connecting the skirt to the sleeve are arranged in the membrane.

2. Distribution system according to claim 1, characterised in that the sleeve is provided with a sealing joint which, in a stable closed state, moves into abutment with an extent of the base in order to close the communication between the interface and the distribution chamber.

3. Distribution system according to claim 1, characterised in that the sleeve comprises a conduit in which an end-piece is mounted, the wall having an extent which extends on a cover of the end-piece and in which the distribution hole is formed.

4. Distribution system according to claim 3, characterised in that the end-piece has a ring which extends below the cover, the ring being mounted in the conduit in order to form the distribution interface with the nozzle.

5. Distribution system according to claim 1, characterised in that the nozzle has a distal end which is provided with a nipple which is arranged in a sealed manner in the distribution hole when the wall is in a stable closed state.

6. Distribution system according to claim 1, characterised in that it comprises a cover which is intended to cover the cap between two distribution actions, the cover comprising at least one protrusion which is arranged so as to move into abutment with the wall when the cover is associated on the cap.

7. Distribution system according to claim 1, characterised in that at least a portion of the wall is capable of ensuring a microbiocidal or at least microbiostatic action in the product arranged on the wall between two distribution actions.

8. Distribution system according to claim 7, characterised in that the wall is produced based on at least one material which has microbiocidal properties by means of diffusion of an antimicrobial agent, by means of contact with a microbiostatic agent and/or by means of irradiation with radiation having a suitable wavelength.

9. Receptacle comprising a deformable tank in which a product is intended to be packaged, the receptacle comprising a distribution system according to claim 1 which is mounted on the tank in order to allow the product to be distributed by means of manual pressure on the tank.

10. Receptacle according to claim 9, characterised in that the tank is surmounted by a neck in which the base is integrated in one piece forming between the neck and the base at least one supply passage.

11. Receptacle according to claim 10, characterised in that the neck has association means on which the skirt of the cap is mounted.

* * * * *